United States Patent [19]

Pullen

[11] Patent Number: 4,837,939

[45] Date of Patent: Jun. 13, 1989

[54] TEMPLATE FOR MARKING OR CUTTING A SHAPED CORNER ON A WORKPIECE

[76] Inventor: Adrian C. Pullen, 9 Jenoves Place, Toronto, Ontario, Canada, M5A 4A6

[21] Appl. No.: 150,853

[22] Filed: Feb. 1, 1988

[51] Int. Cl.[4] ..... B27C 5/10

[52] U.S. Cl. ..... 33/562

[58] Field of Search ..... 33/562, 563, 566, 27.01, 33/27.12; 144/144.5

[56] References Cited

U.S. PATENT DOCUMENTS

| | | | |
|---|---|---|---|
| 2,364,529 | 12/1944 | Hill | 33/565 X |
| 2,549,024 | 4/1951 | Siepe | 33/23.11 X |
| 2,652,866 | 9/1953 | Drain | 33/562 X |
| 3,104,467 | 9/1963 | Young | 33/562 X |
| 4,552,193 | 11/1985 | Armas | 33/562 X |

*Primary Examiner*—Harry N. Haroian

*Attorney, Agent, or Firm*—Robert F. Delbridge; Arne I. Fors

[57] ABSTRACT

A template for marking or cutting a shaped corner on a workpiece has a substantially planar main board-like body with a first side edge provided with first attachment means and a series of separate and different corner portions. Each corner portion has a second side edge buttable with the first side edge of the main body portion and provided with second attachment means releasably co-operable with the first attachment means to detachably secure a selected corner position to the main body portion with the first and second side edges abutting. Each corner portion has a further side edge of desired shape operable, when the corner portion is secured to the main body portion, as a guide for marking or cutting a corner of said desired shape on a workpiece.

8 Claims, 1 Drawing Sheet

FIG. 1.
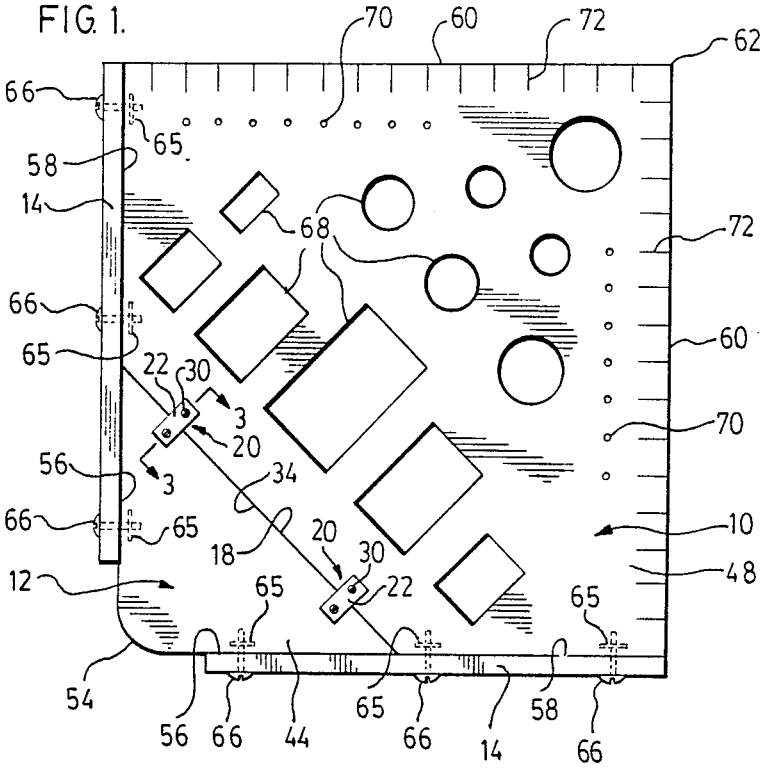
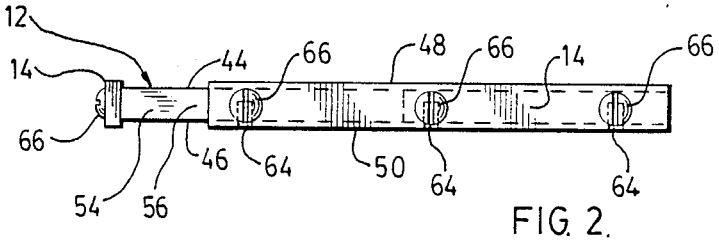
FIG. 2.
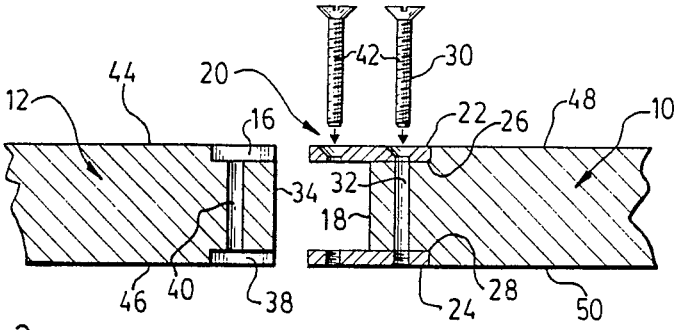
FIG. 3.

TEMPLATE FOR MARKING OR CUTTING A SHAPED CORNER ON A WORKPIECE

This invention relates to templates for marking or cutting a shaped corner on a workpiece.

Prior art templates of this kind are provided with one or more integral shaped corners, with the result that only a limited variety of differently shaped corners can be provided with a single template, thus requiring the provision of a series of different templates if a larger variety of differently shaped corners is required.

It is therefore an object of the invention to provide a template which provides a larger variety of differently shaped corners.

According to the invention, a template comprises a substantially planar main board-like body having a first side edge provided with first attachment means, and a series of separate and different corner portions, each corner portion having a second side edge buttable with the first side edge of the main body portion and provided with second attachment means releasably cooperable with the first attachment means to detachably secure a selected corner portion to the main body portion with said first and second side edges abutting, each corner portion having a further side edge of desired shape operable, when the corner portion is secured to the main body portion, as a guide for making or cutting a corner of said desired shape on a workpiece.

The further side edges of at least some of the corner portions may provide arcuate corners of desired diameters.

The main body portion may have a pair of further side edges extending from opposite ends of first side edge, with the further side edges of the corner portions merging smoothly therewith in a linear manner a corner portion is secured to the main body portion. The template may also include a pair of linear guide members and means for detachably securing said linear guide members to said further side edges of the main body portion in positions in which said guide members each extend along a respective further side edge and project above said body portion to locate a workpiece with respect thereto. The template may also include further means for detachably securing the guide members to the further edges of at least some of the corner portions. The means for detachably securing the guide members may be adjustable to enable the amount by which the guide members project above the corner portion to be varied.

The main body portion may have a pair of rear side edges extending from ends of the further side edges remote from the first side edge thereof, said rear side edges being mutually perpendicular and intersecting at a right-angled corner.

The main body portion may also have a series of differently shaped apertures shaped apertures extending therethrough to function as guides in marking or cutting a desired shape on a workpiece.

One embodiment of the invention will now be described, by way of example, with reference to the accompanying drawings, of which:

FIG. 1 is a plan view of a template in accordance with the invention,

FIG. 2 is a side view thereof, and

FIG. 3 is a cross-sectional along the line of 3—3 of FIG. 1.

Referring to the drawing, a template comprises a solid substantially planar board-like body portion 10, a series of differently-shaped solid corner portions 12 (of which only one is shown in the drawings) of the same thickness as the main body portion 10, and a pair of solid linear guide members 14. The main body portion 10 has a first straight side edge 18 provided with a pair of spaced attachment means 20

Each attachment means 20 comprises upper and lower plate members 22, 24 (see FIG. 3) seated for half their length in recesses 26, 28 in the upper and lower surfaces 48, 50 respectively of the main body portion 10 adjacent a first side edge 18, such that the other half of the length of the plate members 22, 24 projects perpendicularly from the first side edge 18. The plate members 22, 24 are secured in place by a bolt 30 which passes through an aperture in the upper plate member 22 and through a bore 32 in the main body portion 10 into a threaded aperture in the lower plate member 24.

Each corner portion 12 has a second straight side edge 34 abuttable with the straight first side edge 18 of the main body portion 10, and spaced pairs of upper and lower recesses 36, 38 adjacent the first side edge 34. A bore 40 extends through the corner portion 12 from the upper recess 36 to the lower recess 38. As is readily apparent from FIG. 3, each corner portion 12 is securable to the main body portion 10 with the first and second side edges 18, 34 abutting by causing the portions of the upper and lower members 22, 24 projecting from the first side edge 18 of the main body portion 10 to enter the recesses 36, 38 of the corner portion 12, and then passing a bolt 42 through an aperture in each upper plate member 22 and through the bore 40 into a threaded aperture into the lower plate 24.

Because the corner portions 12 are the same thickness as the main body portion 10, the upper and lower surfaces 44, 46 are respectively co-planar with the upper and lower surfaces 48, 50 of the main body portion 10 when a corner portion 12 is secured thereto.

Each corner portion 12 has a further side edge of desired shape. The particular corner portion 12 shown in the drawings has a further side edge 52 which forms a arcuate corner 54 of desired radius and mutually perpendicular straight portions 56 extending from the corner 54 to the second side edge 34. The main body portion 10 has a pair of mutually perpendicular further straight side edges 58 extending from opposite ends of the first side edge 18, and the straight portion 56 of the further side edge 52 of a corner portion 12 merge smoothly therewith in a linear manner. The main body portion 10 has a pair of mutually perpendicular rear side edges 60 extending from the ends of the further side edges 58 remote from the first side edge 18, the rear side edges 60 intersecting at a right-angled corner 62.

Each guide member 14 has three spaced recesses 64 extending upwardly from its lower edge. Two bolts 66 pass through the two rearmost recesses 64 into threaded engagement in the respective side edge 58 of the main body portion 10, and a further screw 66 passes through the foremost recess 64 into threaded engagement plates 65 with the respective side edge 56 of corner portion 12. Each guide member 14 projects slightly above upper surfaces 44, 48 of the corner portion 12 and main body portion 10, the actual projecting amount being adjustable by loosening the screw 66 and moving the guide members 14 upwardly or downwardly, such movement being permitted by the recesses 64.

The guide members 14 are used in the manner illustrated only with corner portions 12 having an arcuate corner 54 of relatively small radius, for example up to about 3 inches. With corner portions 12 having arcuate corners 54 of larger radius, the guide members 14 will be located so that they do not overlap the corner portion 12 but project rearwardly from the main body portion 10, being mounted only on bolts 66 which threadingly engage the main body portion.

The main body portion 10 also has a series of differently shaped apertures 68 extending therethrough to function as guides in marking or cutting (such as with a router) a desired shape of a workpiece, for example for door hinges, locks or handles. Another series of differently sized circular apertures 70 is provided to enable sizes of bolts and screws to be determined. Side edges 60 provided with graduation 72 so that they can be used individually as measuring devices or in combination as a framing square.

A person skilled in the art will readily appreciate the advantages of the above described embodiment of the template. The template may be used with a router or other cutting tool or may be used for marking a workpiece as required. As described, corner portions 12 are readily interchangeable to provide arcuate corners 54 of different radii (or of course any other desired shape).

Other advantages and embodiments of the present invention will also be readily apparent to a person skilled in the art from the foregoing description of a preferred embodiment the scope of the invention being defined in the appended claims.

What is claimed is:

1. A template for marking or cutting a shaped corner on a workpiece, said template comprising a substantially planar main board-like body having a first side edge provided with first attachment means, and a series of separate and different corner portions, each corner portion having a second side edge buttable with the first side edge of the main body portion and provided with second attachment means releasably co-operable with the first attachment means to detachable secure a selected corner portion to the main body portion with said first and second side edges abutting, each corner portion having a further side edge of desired shape operable, when the corner portion is secured to the main body portion, as a guide for marking or cutting a corner of said desired shape on a workpiece, the main body portion having a pair of mutually perpendicular further side edges extending form opposite ends of said first side edge, and the further side edge of the corner portion merging smoothly therewith in a linear manner when a corner portion is secured to the main body portion.

2. A template according to claim 1 wherein said further side edges of at least some of the corner portions provide arcuate corners of desired radii.

3. A template according to claim 1 also including a pair of linear guide members and means for detachably securing said linear guide members to said further side edges of the main body portion in positions in which said guide members each extend along a respective further side edge and project above said body portion to locate a workpiece with respect thereto.

4. A template according to claim 3 wherein the means for detachably securing said linear guide members is adjustable to enable the amount by which the guide members project above the main body portion to be varied.

5. A template according to claim 3 also including further means for detachably securing the guide members to the further edges of at least some of said corner portions.

6. A template according to claim 5 wherein the means for detachably securing said linear guide members is adjustable to enable the amount by which the guide members project above the said corner portions to be varied.

7. A template according to claim 1 wherein the main body portion has a pair of rear side edges extending from ends of the further side edges remote from the first side edge thereof, said rear side edges being mutually perpendicular and intersecting at a right-angled corner.

8. A template according to claim 1 wherein the main body portion has a series of differently shaped apertures extending therethrough to function as guides in marking or cutting a desired shape on a workpiece.

* * * * *